United States Patent [19]

Ma

[11] Patent Number: 4,626,862

[45] Date of Patent: Dec. 2, 1986

[54] ANTENNA HAVING COAXIAL DRIVEN ELEMENT WITH GROUNDED CENTER CONDUCTOR

[76] Inventor: John Ma, 499 Dundee Ave., Milpitas, Calif. 95035

[21] Appl. No.: 639,667

[22] Filed: Aug. 8, 1984

[51] Int. Cl.[4] ..... H01Q 1/24

[52] U.S. Cl. ..... 343/702; 343/790; 343/895

[58] Field of Search ..... 343/790–792, 343/741, 842, 895, 702

[56] References Cited

U.S. PATENT DOCUMENTS

| | | | |
|---|---|---|---|
| 676,332 | 6/1901 | Marconi | 343/790 |
| 2,529,213 | 11/1950 | Goldsmith | 343/790 |
| 2,533,078 | 12/1950 | Woodward | 343/790 |
| 3,573,628 | 4/1971 | Cramer, Jr. et al. . | |
| 3,622,890 | 11/1971 | Fujimoto et al. . | |
| 3,623,161 | 11/1971 | Fujimoto et al. . | |
| 3,736,591 | 5/1973 | Rennels et al. . | |
| 3,774,218 | 11/1973 | Fowler | 343/741 |
| 3,863,157 | 1/1975 | Quinlan et al. . | |
| 4,103,241 | 7/1978 | Najork | 325/373 |
| 4,254,422 | 3/1981 | Kloepfer et al. | 343/792 |
| 4,270,128 | 5/1981 | Drewett . | |
| 4,543,583 | 9/1985 | Wurdack | 343/792 |

FOREIGN PATENT DOCUMENTS

| | | | |
|---|---|---|---|
| 869365 | 3/1953 | Fed. Rep. of Germany | 343/790 |
| 260005 | 3/1927 | United Kingdom | 343/790 |
| 643577 | 9/1950 | United Kingdom | 343/790 |

OTHER PUBLICATIONS

Jasik, *Antenna Engineering Handbook,* 1st ed., McGraw-Hill Book Co., New York (1961) pp. 22–28.

*Radio Amateur's Handbook,* American Radio Relay League, Newington, Conn. (1969) pp. 369–381.

Brown et al., *Lines, Waves, and Antennas,* 2nd ed., Ronald Press Co. New York (1973) pp. 80, 150, 344–345.

*Primary Examiner*—Eli Lieberman

*Attorney, Agent, or Firm*—Leydig, Voit & Mayer

[57] ABSTRACT

An elongated active element for an antenna has an internal resonator providing a high quality matching impedance. The internal resonator is formed by a pair of conductors including an outer conductor and a coaxial inner conductor that is connected to signal ground. The signal connection of the active element is made to one end of the outer conductor in the neighborhood of the ground connection to the inner conductor. The inner conductor is shorted to the outer conductor at approximately a quarter of a wavelength, plus an integral number of half wavelengths, from the signal and ground connections to provide a parallel-resonant condition complementing the series resonant characteristics of the radiation impedance of the active element. Preferably, the active element is approximately a quarter wavelength long, and may be lengthened or shortened to obtain a desired radiation resistance. The antenna is easily fabricated from a length of coaxial cable. The antenna is advantageously used in pagers and other kinds of VHF and UHF radios, since the coaxial cable can be coiled to fit inside a miniature radio housing. For relatively low frequencies, a coil of coaxial cable including a number of turns provides a relatively efficient broadband antenna.

5 Claims, 13 Drawing Figures

Fig. 1.
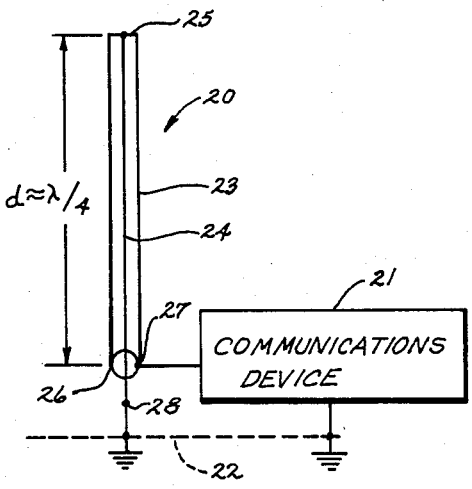
Fig. 6.
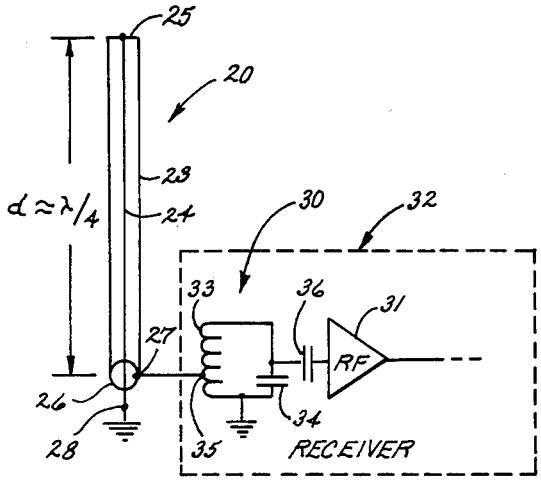
Fig. 2.
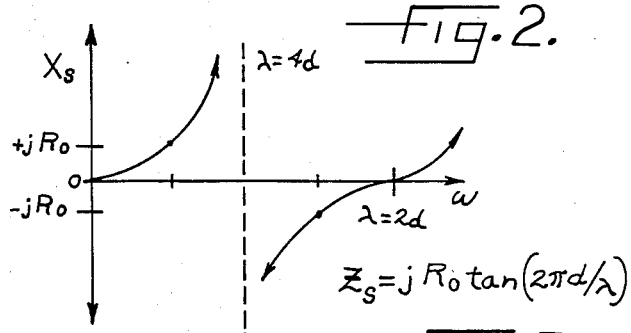
Fig. 5.
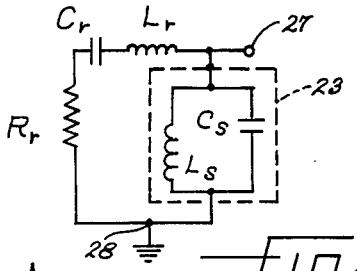
Fig. 3.
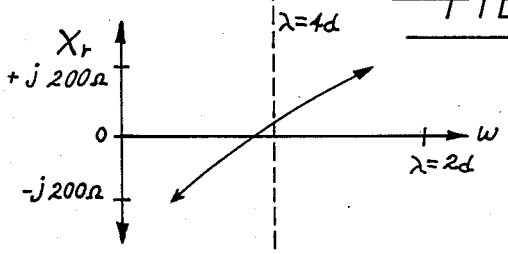
Fig. 4.
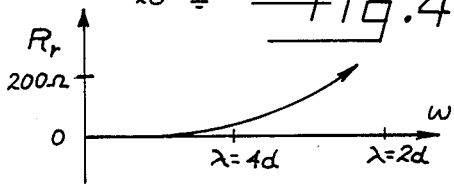
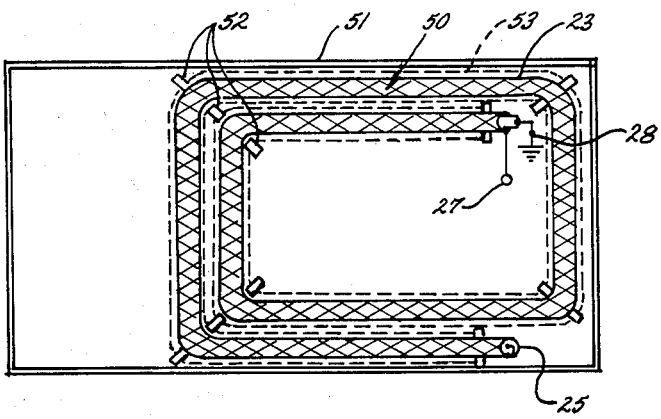
Fig. 8.
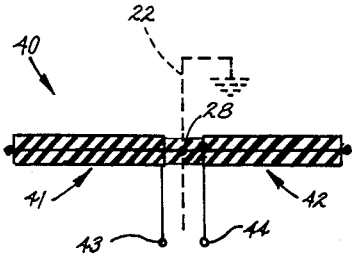
Fig. 7.

Fig. 9.
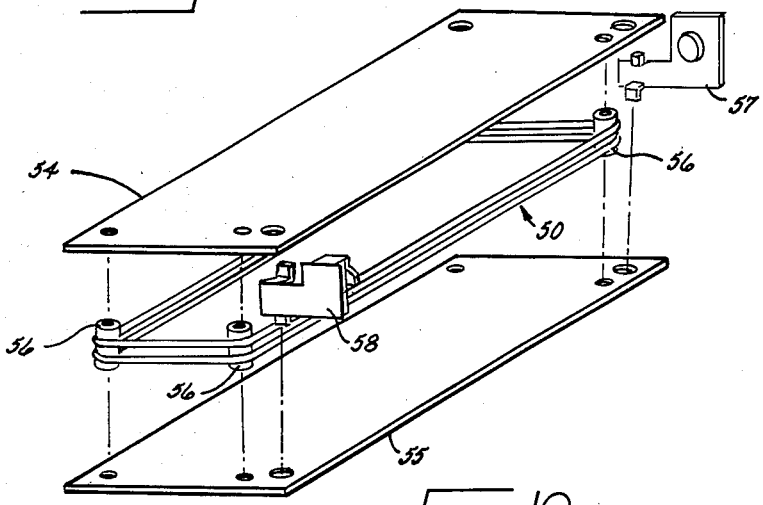
Fig. 13.
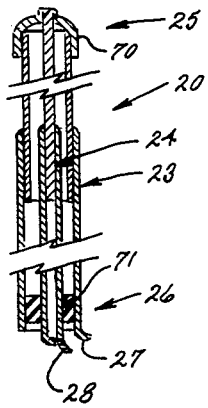
Fig. 10.
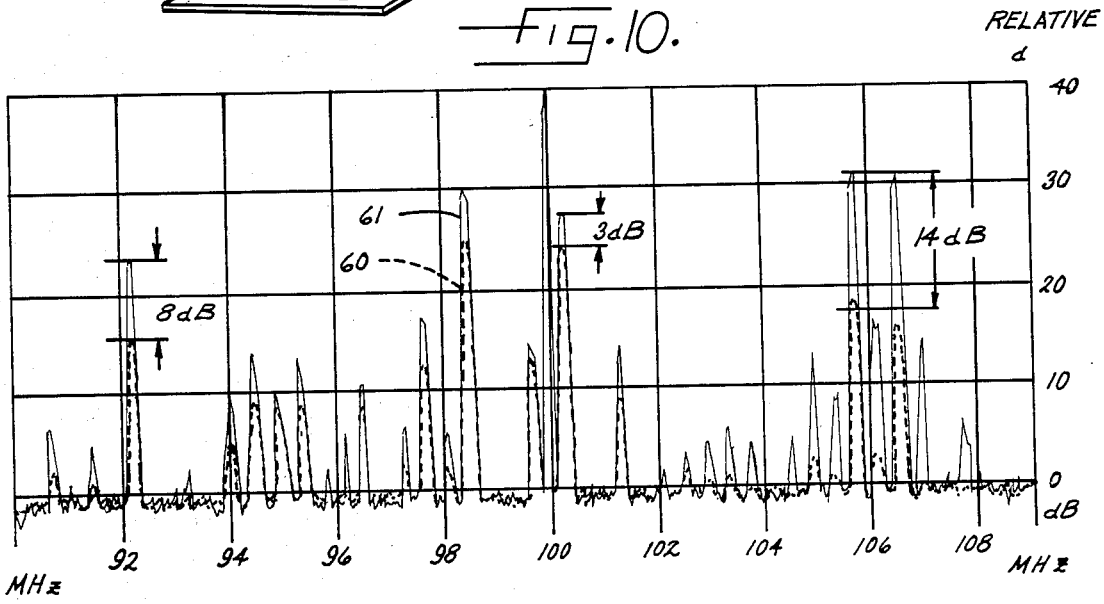
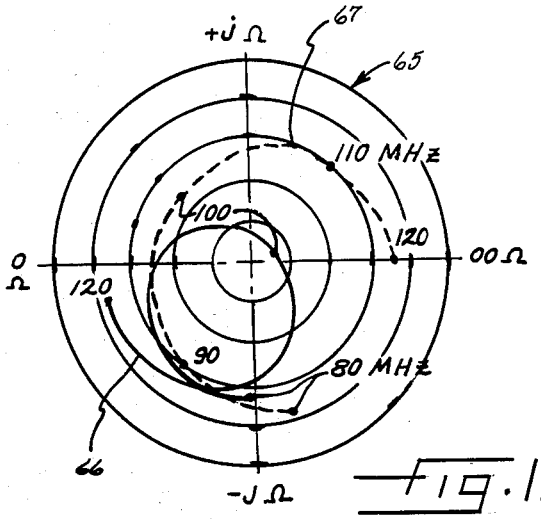
Fig. 11.
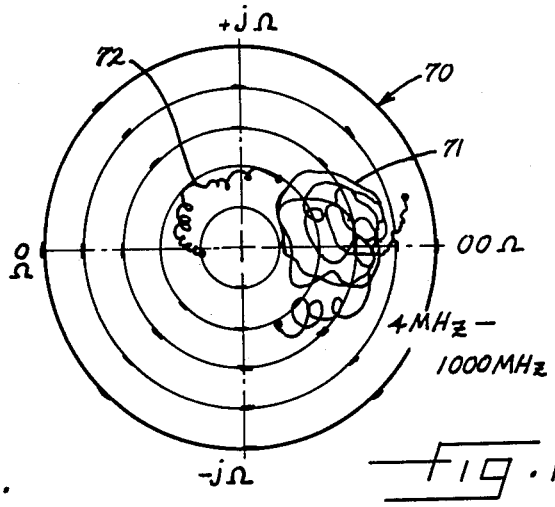
Fig. 12.

ANTENNA HAVING COAXIAL DRIVEN ELEMENT WITH GROUNDED CENTER CONDUCTOR

FIELD OF THE INVENTION

This innvention relates to the field of radio communication, and specifically to compact antennas for miniature radio receivers.

BACKGROUND OF THE INVENTION

Ever since the invention of radio communication by Marconi in 1897 there has been an effort to reduce the size of antennas and radio equipment. The early broadcast radio receivers employed bulky tuners and vacuum tubes, and required external long-wire antennas. Later miniature vacuum tubes were developed permitting portable radio receivers, and it was discovered that a flat pancake coil mounted to the rear panel of the radio receiver could provide an unobstrusive AM antenna. The power cord of the radio was typically used as an FM antenna.

With the introduction of the transistor in the 1950s, pocket-size radios were economical to mass produce. For the AM broadcast band, a coil antenna was wound on a ferrite core to further reduce its size without excessive loss of signal. For the FM broadcast band, a telescoping whip antenna was used, preferably extensible to a quarter wavelength.

Today integrated circuitry permits the manufacture of miniature pocket pagers, "wrist" radios, and radios fitting into light weight stereo headphones. The shrinking of the antenna to accommodate the smaller radios does, however, severely reduce the received signal levels. The antennas for these miniature radios typically consist of internal tuned coils connected to belt buckles, wrist straps, or dangling wires.

SUMMARY OF THE INVENTION

Accordingly, the basic object of the invention is to provide a compact, unobtrusive antenna for a miniature radio.

Another object is to provide an improved antenna for a communications device operating at about 500 kilohertz to 1000 megahertz.

Still another object of the invention is to provide an integral low-loss matching circuit for an antenna.

And yet another object of the invention is to provide a relatively compact broad band antenna. In this regard, a particular object of the invention is to provide a compact antenna for a pager operating on the FM broadcast band which has a relatively flat response across the entire FM band.

BRIEF DESCRIPTION OF THE DRAWINGS

Other objects and advantages of the invention will become apparent from the following detailed description and the accompanying drawings, in which:

FIG. 1 is a schematic diagram of a quarter wave whip antenna employing a section of coaxial cable according to the present invention;

FIG. 2 is a graph of reactance as a function of frequency for a shorted quarter wave section of coaxial cable;

FIG. 3 is a graph of reactance as a function of frequency for a quarter wave whip antenna;

FIG. 4 is a graph of radiation resistance as a function of frequency for a quarter wave whip antenna;

FIG. 5 is an electrical circuit model of the quarter wave whip antenna using a section of coaxial cable as shown in FIG. 1;

FIG. 6 is a schematic drawing of a matching circuit which may be used to connect the antenna as shown in FIG. 1 to a radio receiver;

FIG. 7 is a schematic diagram of a dipole antenna employing the present invention;

FIG. 8 is a pictorial diagram illustrating one method for mounting a coaxial antenna according to the present invention inside the housing of a miniature radio receiver;

FIG. 9 is a pictorial diagram illustrating the preferred method for mounting a coaxial antenna of the present invention inside a miniature radio receiver having a pair of printed circuit boards;

FIG. 10 is a comparative illustration of the spectrum of the FM broadcast band obtained with the conventional antenna of a REACH Co. SCA pager, and the spectrum obtained with the antenna according to the present invention as shown in FIG. 8;

FIG. 11 is a Smith chart of the electrical characteristics of the coaxial antenna as shown in FIG. 8, and comparatively showing the effect of grounding the center conductor of the antenna;

FIG. 12 is a Smith chart of the electrical characteristics of a coil of 200 feet of coaxial cable over the frequency range of 4 megahertz to 1000 megahertz, and comparatively showing the effect of grounding the center conductor of the coaxial cable; and FIG. 13 is a sectional view of an adjustable rigid coaxial antenna according to the present invention.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Turning now to FIG. 1, there is shown a quarter wave whip antenna generally designated 20 used by a communications device 21. As is well known, the quarter wave whip antenna 20 is preferably used in conjunction with a ground plane 22 that is perpendicular to the quarter wave antenna 20. It is known that the quarter wave whip antenna is a particularly efficient electromagnetic radiator or receiver, since an electrical resonance condition exists when the length d of the antenna is approximately a quarter wavelength $\lambda/4$, and the antenna is a reasonably efficient radiator when resonance occurs.

The inventor has discovered that the electrical characteristics of the quarter wave whip antenna 20 are substantially improved by fabricating the quarter wave antenna 20 from a section of coaxial cable which provides an additional complementary resonance condition.

As specifically shown in FIG. 1, the antenna 20 includes a quarter wavelength section of coaxial cable having an outer conductor 23 and an inner conductor 24 separated by a dielectric. The outer and inner conductors 23, 24 are connected at a first end portion 25 of the quarter wave section. The quarter wave section has a signal connection 27 to the outer conductor 23 at a second end portion 26. Also at the second end portion 26, the inner conductor 24 has a signal ground connection 28.

It should be evident that in the antenna 20, the outside portion of the outer conductor 23 in cooperation with the ground plane 22 converts electromagnetic radiation in the vicinity of the antenna 20 to an electrical signal obtained at the signal connection 27 with respect to signal ground. In addition, the inner conductor 24 cooperates with the inner portion of the outer conductor 23 to provide a high quality matching impedance in parallel connection with the signal connection 27 and the ground connection 28.

The electrical characteristics of the antenna 20 in FIG. 1 are illustrated in part by FIGS. 2-5. FIG. 2 is a graph of reactance versus frequency for the resonant circuit formed by the inner conductor 24 and the inner portion of the outer conductor 23. In this regard, the resonant circuit is that of a shorted quarter wavelength stub. As is well-known, the impedance of a shorted stub is expressly by the following formula:

$$Z_s = jR_0 \tan(2\pi d/\lambda)$$

In the vicinity of a frequency $\omega$ for which $\lambda=4d$, the shorted stub functions as a parallel-resonant LC circuit, such as the circuit shown in FIG. 5 comprising the inductance $L_s$ and the capacitance $C_s$. Such a parallel-resonant LC circuit has a reactance $X_s$ which is 0 at $\omega=0$, an indefinite and infinite reactance $X_s$ at the frequency $\omega$ for which $\lambda=4d$, and a relatively small reactance $X_s$ for frequencies $\omega$ much greater than the frequency at which $\lambda=4d$. The shorted stub, however, has a reactance $X_s$ that is periodic or replicates for frequencies $\omega$ at which $d=\lambda/4$ plus an integral number of half wavelengths, due to the periodic nature of the tangent function. The parallel-resonant LC circuit does not exhibit such periodicity.

The outer portion of the outer conductor 23 of the antenna 20 in cooperation with the ground plane 22 exhibits a complementary series resonant condition shown in FIG. 3. The reactance $X_r$ of this series-resonant condition exhibits a substantially linear dependence on frequency $\omega$ in the vicinity of the frequency for which $\lambda=4d$. This series resonant condition is modeled in FIG. 5 by the series connection of a capacitor $C_r$ and an inductor $L_r$. Series resonance occurs at the frequency $\omega$ for which the reactance $X_r$ is subtantially 0. As shown in FIG. 5, the outer conductor 23 functions as a shield to decouple the electromagentic fields of the parallel-resonant circuit $L_s$ $C_s$ from the series-resonant circuit $L_r$ $C_r$.

The electrical characteristics of the outer portion of the outer conductor 23 in conjunction with the ground plane 22 also has a resistive component known as the radiation resistance $R_r$. As shown in FIG. 4, the radiation resistance $R_r$ is an increasing function of frequency and begins to increase rather rapidly at the frequency for which $\lambda=4d$. As shown in FIG. 5, the radiation resistance $R_r$ is modeled by a resistor in series with the capacitance $C_r$ and inductance $L_r$.

FIGS. 2-5 suggest that the parallel resonance of FIG. 2 is complementary to the series resonance of FIGS. 3 and 4 so that the antenna 20 has a substantially constant reactance X in the vicinity of the frequency for which $\lambda=4d$. For frequencies $\omega$ substantially less than the frequency for which $\lambda=4d$, the inductive component $L_s$ will tend to cancel the capacitive component $C_r$. For frequencies $\omega$ substantially greater than the frequency for which $\lambda=4d$, the capacitance $C_s$ will tend to cancel the inductance $L_r$. This cooperation or coupling between the parallel-resonant circuit $L_s$ $C_s$ and the series-resonant circuit $L_r$ $C_r$ involves an exchange of current which flows or resonates between the inner and outer surfaces of the outer conductor 23 when the frequency $\omega$ deviates from the frequencey $\omega$ for which $\lambda=4d$. Also, in the vicinity of the frequency $\omega$ for which $\lambda=4d$, the radiation resistance $R_r$ will predominate over a substantially greater band width. It is of particular importance that the radiation resistance $R_r$ becomes the predominate element in the equivalent circuit of FIG. 5. In contrast to the use of a discrete inductor $L_s$ and a discrete capacitor $C_s$, the shorted quarter wave stub effectively provided by the outer and inner conductors 23, 24 ensures that there are no resistive losses in the equivalent circuit which are significant in comparison to the radiation resistance $R_r$. Due to the periodic nature of the reactances $X_s$, $X_r$ and the radiation resistance $R_r$ as a function of frequency, these benefits should also be obtained when the length d of the antenna 20 is any odd number of quarter wavelengths, since resonance also occurs for these lengths.

Turning to FIG. 6 there is shown a circuit generally designated 30 for matching the impedance of the antenna 20 to the input impedance of a radio frequency amplifier 31 in a radio receiver 32. The impedance matching circuit 30 consists of a tapped inductor 33 in parallel with a capacitor 34. Typically the antenna 20 has an impedance of about 50 ohms and the radio frequency amplifier 31 has an input impedance of about 150 ohms. For this reason, the signal connection 27 of the antenna is applied to a tap 35 on the coil 33, and the coil 33 and capacitor 34 are connected through a bypass capacitor 36 to the input of the radio frequency amplifier 31.

Turning to FIG. 7 there is shown a dipole antenna generally designated 40 employing the present invention. It should be noted that the dipole antenna 40 has two active element sections generally designated 41 and 42 which are each approximately a quarter of a wavelength long, so that the entire dipole 40 is approximately $\lambda/2$ in length. The ground plane 22 and ground connection 28 inherently arise due to the fact that the dipole 40 is symmetrical and has two signal connections 43 and 44 which are balanced with respect to the ground plane 22.

Although FIGS. 1, 6, and 7 show antennas having linear or straight quarter wavelength sections, for use as unobtrusive antennas in miniature radio receivers, the quarter wavelength sections are preferably coiled to save space. As shown in FIG. 8, a quarter wavelength segment of coaxial cable generally designated 50 is coiled and secured to a minature radio enclosure or housing 51. The housing 51 is made of plastic or some other non-conductive material and the coaxial cable 50 is easily secured to the housing 51 by clips 52 molded into the plastic case 51. The coaxial cable 50 is of conventional construction including an insulating jacket 53 covering a braided outer conductor 23. Alternatively, semi-rigid coaxial cable could be used consisting of an insulated wire center conductor threaded into a soft-drawn copper tube. the arrangement shown in FIG. 8 is suitable for miniature receivers working in the FM broadcast band. In this case, the coaxial cable 50 is coiled into a coil including approximately two turns.

The ground plane in FIG. 8 is provided by a printed circuit board (not shown) including electrical components for the radio receiver.

It has been found that if more than two turns of coaxial cable 50 are needed, they are preferably not wound in the form of a pancake coil. Rather, they should be wound as shown in FIG. 9. The segment of coaxial cable 50 is disposed between two printed circuit boards 54 and 55. The coaxial cable 50 is wound on spacers or posts 56 which also provide a mechanical connection between the two circuit boards 54 and 55 after assembly. Also shown in FIG. 9 are battery connecting plates 57 and 58 which also become sandwiched between the two circuit boards after assembly. The particular construction in FIG. 9 leads to a very compact and space saving arrangement for the battery, antenna, and electronic circuits for a miniature radio receiver such as a pocket pager.

The antennas as shown in FIG. 8 and FIG. 9 are particularly useful for a pocket pager receiving SCA or subcarrier signals on the FM broadcast band. It is most desirable if such a pager is tunable in the field to any selected frequency in the FM broadcast band. In particular, such tuning should be easily performed and for economy sake should not require expensive tuning circuits. Tuning of the receiver to any desired frequency is considerably simplified if the antenna 50 has a frequency response that is flat across the entire FM broadcast band so long as this flat response is not obtained by sacrificing the sensitivity of the antenna. As was suggested above in connection with FIGS. 2–4, the complementary nature of the series resonant radiation characteristic with respect to the parallel resonant characteristic of the shorted coaxial cable should result in a broad band antenna without a sacrifice in sensitivity. Also, if the radiation resistance may be effectively increased in relation to the parasitic impedances in the antenna, then there may also be an improvement in antenna sensitivity over the entire frequency band.

Some actual test results for the antenna configuration as shown in FIG. 8 are plotted in FIG. 10. The dashed curved 60 is the FM broadcast spectrum obtained by a prior art antenna used in a REACH Co. pocket pager operating on the FM broadcast band and tuned to 100 megahertz. The solid curve 61 shows the FM broadcast spectrum obtained by the antenna configuration as shown in FIG. 8. At 100 megahertz for which the REACH Co. antenna was tuned, the antenna configuration of FIG. 8 gave approximately a 3 dB improvement in sensitivity relative to the noise floor of the spectrum which has been arbitrarily assigned 0 dB. The curves 60 and 61 were plotted by a spectrum analyzer. The peaks in the spectrum represent commercial FM broadcast stations in the Santa Clara, Calif. vicinity at the time the tests were made. The improvement of the antenna configuration as shown in FIG. 8 is especially striking at the ends of the FM band, displaced from the 100 megahertz frequency for which the antennas were tuned. At about 106 megahertz, the antenna according to the invention resulted in an improvement of about 14 dB. At 92 megahertz, the antenna according to the invention gave an improvement of about 8 dB.

The experimental results as shown in FIG. 10 naturally raise the question of what portion of the improvement results from the coaxial nature of the antenna 50. The precise question is whether the shorting of the inner conductor 24 (FIG. 1) of the antenna 20 at the first end 25 and the grounding of the inner conductor at the second end 26 is primarily responsible for the improvement displayed in FIG. 10. To decide this question, the electrical characteristics of the antenna configuration as shown in FIG. 8 were measured over the frequency range of 80 to 120 megahertz first with the inner conductor 24 connected to signal ground, and then for the case of the inner conductor 24 shorted to the outer conductor 23 at both ends of the coaxial cable 50. Since the electrical characteristics of the antenna are most relevant insofar as they relate to the ability of the antenna to cooperate with a fixed input impedance of the receiver, the electrical characteristics of the antenna where measured by a vector voltmeter which displays the electrical characteristics in the format of a Smith chart.

As is well known, a Smith chart displays the electrical characteristics of a two-terminal device within a circular region. The center of the circular region represents a resistive impedance equal to a characteristic impedance, for example, the impedance to be matched to the antenna. For the Smith chart generally designated 65 in FIG. 11, the center point represents a resistive impedance of 50 ohms. On the Smith chart 65, the distance from the center represents a mis-match between the antenna and the characteristic 50 ohm impedance. Specifically, the distance represents the magnitude of a reflection coefficient ranging from zero at the center to one at the periphery of the Smith chart. The Smith chart 65 also has a pair of orthogonal coordinate axis. The horizontal axis represents points for which an antenna has a plurely resistive impedance. Points above the horizontal axis, in the $+j\omega$ direction, represent antenna impedances having an inductive component. The portion of the Smitch chart below the horizontal axis, in the $-j\omega$ direction, represents antenna impedances having a capacitive component. Specifically, the angle of a point on the Smith chart with respect to the center and the coordinate axis represents the angle of the reflection coefficient of the antenna when the antenna is connected to a source or driving impedance of the characteristic impedance. If the antenna were merely a shorted section of coaxial cable with the outer conductor 23 grounded and the inner conductor 24 being connected at the signal connection, then the electrical characteristics of such an antenna would fall on the outer periphery of the Smith chart at an angle depending on the length of the coaxial cable.

The electrical characteristics for the antenna shown in FIG. 8 are plotted as a solid line 66 on the Smith chart 65. The electrical characteristics obtained when the inner conductor is disconnected from signal ground 28 and shorted to the signal connection 27 are shown as a dashed line 67 on the Smith chart 65. The electrical characteristics plot as curves rather than single points since the characteristics are obtained over a range of frequencies from 80 megahertz to 120 megahertz. In each case, the curves 66, 67 are generally in the form of circular arcs. The circular arc 66 obtained when the center conductor 21 is grounded has a much smaller radius than the circular arc 67 obtained when the inner conductor 24 is shorted to the signal connection 27. A small radius is desirable since then a fixed matching circuit such as 30 in FIG. 6 can be selected to obtain a good match between the antenna and the radio receiver over a rather wide frequency range. Thus, the fact that the antenna is comprised of a coaxial cable with a grounded inner conductor rather than, for example, a solid conductor, is substantially responsible for the improved performance illustrated in FIG. 10.

A coaxial cable with a grounded inner conductor could be used as an antenna over a wide frequency range including rather low frequencies. Shown in FIG. 12 is a Smith chart generally designated 70 on which are plotted electrical characteristics of a coil of 200 feet of coaxial cable measured over a frequency range of 4 megahertz to 100 megahertz. A curve 71 was obtained when the inner conductor of the coaxial cable was shorted to the outer conductor of the cable at each end of the cable. The curve 71 has many large loops or excursions over a number of sub-intervals in frequency. A curve 72 was obtained when the inner conductor of the coaxial cable was shorted to the outer conductor at one end and connected to signal ground at the other end as shown in FIG. 1. The curve 72 also has a number of loops of excursions but the loops are relatively small. Thus, even a rather long coaxial cable antenna having a large number of turns acts as a broad band antenna about a rather low frequency. The use of a coaxial cable as an active element in an antenna, in other words, should have utility over the frequency range for which a shorted coaxial cable functions as an efficient resonator, or approximately 500 kilohertz to 1000 megahertz. Broad band utility can be obtained at UHF frequencies by using an adjustable antenna as shown in FIG. 13. The inner and outer conductors 23, 24 are provided by telescoping sections similar to sections used in conventional telescoping whip antennas. In other words, the antenna is comprised of adjustable length coaxial line. The length is adjustable to a quarter wavelength over a wide range of frequencies. The outer and inner conductors are shorted at a first end portion 25 by a cap 70, and are insulated at the second end portion by a dielecric spacer 71.

In view of the above, a coaxial cable with its inner conductor grounded is advantageously used as an active element in an antenna. In particular, a segment of coaxial cable approximately a quarter of a wavelength long and formed into a coil of approximately two turns provides a compact unobtrusive antenna for a miniature radio receiver operating on FM broadcast band. The coaxial cable functions both as a shorted quarter wave stub or parallel resonator and as a quarter wave antenna or series resonator so that the series and parallel resonance conditions complement each other to increase the bandwidth of the antenna about the resonance frequency.

What is claimed is:

1. An antenna for conversion of electromagnetic radiation having a predefined wavelength, said antenna including a segment of coaxial cable, said segment of coaxial cable having a total length of approximately one quarter of a wavelength, said segment of coaxial cable being coiled to form a coil having at least one complete turn, said coaxial cable having outer and inner conductors being electrically connected together at a first end of the segment of coaxial cable, and having a signal connection to the outer conductor at a second end of the segment of coaxial cable, and the inner conductor being approximately at signal ground at the second end, so that the outside portion of said outer conductor in cooperation with the signal ground provides conversion between said electromagnetic radiation and an electrical signal at said signal connection, and said inner conductor in cooperation with said dielectric and the inner portion of said outer conductor provides a high quality matching impedance in parallel connection with said signal connection and said signal ground.

2. The antenna as claimed in claim 1, wherein said coil is rectangular and includes approximately two turns.

3. The antenna as claimed in claim 2, wherein the segment of coaxial cable is coiled inside a nonconductive case of a miniature pager receiver operating on the standard FM broadcast band.

4. The antenna as claimed in claim 1, wherein the segment of coaxial cable in coiled inside a nonconductive case of a miniature radio receiver including two generally coplanar circuit boards separated by spacers, the segment of coaxial cable is disposed between the circuit boards and wound on said spacers, and the circuit boards include printed circuits for said radio receiver and provide said signal ground.

5. An unobtrusive antenna for a miniature radio receiver operating on the standard FM broadcast band, said radio receiver having printed circuits on two generally coplanar and rectangular circuit boards separated by spacers, said antenna including a segment of coaxial cable having a total length of approximately a quarter wavelength, said segment of coaxial cable being coiled about said spacers and disposed between said circuit boards to form a rectangular coil of approximately two turns, said coaxial cable having outer and inner conductors separated by a dielectric, the outer and inner conductors being electrically connected together at a first end of the segment of coaxial cable, and having a signal connection from said printed circuits to said outer conductor at a second end of the segment of coaxial cable, the inner conductor at said second end being connected to signal ground portions of said printed circuit boards, so that the outside portion of said outer conductor in cooperation with the signal ground provides conversion between said electromagnetic radiation and an electrical signal at said signal connection, and said inner conductor in cooperation with said dielectric and the inner portion of said outer conductor provides a high quality matching impedance in parallel connection with said signal connection and said signal ground.

* * * * *